US009839958B2

(12) United States Patent
Park et al.

(10) Patent No.: US 9,839,958 B2
(45) Date of Patent: Dec. 12, 2017

(54) METHOD FOR INDUCTION STIRRED, ULTRASONICALLY MODIFIED INVESTMENT CASTINGS

(71) Applicant: GENERAL ELECTRIC COMPANY, Schenectady, NY (US)

(72) Inventors: Junyoung Park, Greer, SC (US); Jason Robert Parolini, Geer, SC (US); Ibrahim Ucok, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 220 days.

(21) Appl. No.: 15/007,941

(22) Filed: Jan. 27, 2016

(65) Prior Publication Data

US 2016/0136725 A1 May 19, 2016

Related U.S. Application Data

(62) Division of application No. 13/330,879, filed on Dec. 20, 2011, now Pat. No. 9,278,389.

(51) Int. Cl.

| | |
|---|---|
| ***B22D 27/02*** | (2006.01) |
| ***B22D 27/08*** | (2006.01) |
| ***B22C 9/04*** | (2006.01) |
| ***B22C 7/02*** | (2006.01) |
| ***B22D 27/04*** | (2006.01) |
| ***B22D 27/20*** | (2006.01) |

(52) U.S. Cl.

CPC ..... *B22C 9/043* (2013.01); *B22C 7/02* (2013.01); *B22D 27/02* (2013.01); *B22D 27/04* (2013.01); *B22D 27/045* (2013.01); *B22D 27/08* (2013.01); *B22D 27/20* (2013.01)

(58) Field of Classification Search

CPC ..... B22C 9/04; B22C 9/043; B22D 27/02; B22D 27/04; B22D 27/08; B22D 27/20

USPC ..... 164/122, 122.1, 501

See application file for complete search history.

(56) References Cited

U.S. PATENT DOCUMENTS

| | | | | |
|---|---|---|---|---|
| 3,447,587 A | | 6/1969 | Bodine | |
| 3,568,752 A | * | 3/1971 | Williams | B22D 27/08 164/114 |
| 4,770,704 A | | 9/1988 | Gibson et al. | |
| 4,813,470 A | * | 3/1989 | Chiang | B22D 27/045 164/122.1 |
| 4,832,112 A | * | 5/1989 | Brinegar | B22D 27/00 164/122 |

(Continued)

*Primary Examiner* — Kevin E Yoon

(74) *Attorney, Agent, or Firm* — McNees Wallace & Nurick LLC

(57) ABSTRACT

A method for making an equiaxed investment casting. The method utilizes an ultrasonic generator to send an ultrasonic pulse into molten metal in an investment casting mold. The investment casting mold is positioned within a working zone of furnace having low output induction coils for generating a convection current in molten metal. The ultrasonic pulse separates dendrites growing from the face of the mold inward into the molten metal. Instead, equiaxed grains can nucleate within the molten metal. In addition, the ultrasonic pulse and the low output induction coils circulate the molten metal as solute is rejected from solidifying equiaxed grains. The mixing reduces the effects of segregation in the solidifying alloy and assists in nucleating equiaxed grains.

19 Claims, 4 Drawing Sheets

(56) References Cited

U.S. PATENT DOCUMENTS

| | | | | |
|---|---|---|---|---|
| 4,850,419 | A * | 7/1989 | Blazek | B22D 27/045 164/122.1 |
| 5,309,976 | A | 5/1994 | Prichard et al. | |
| 5,335,711 | A * | 8/1994 | Paine | B22D 27/13 164/120 |
| 5,944,088 | A | 8/1999 | Feagin | |
| 6,939,388 | B2 | 9/2005 | Angeliu | |
| 7,465,365 | B1 | 12/2008 | Angeliu | |
| 2004/0016318 | A1 | 1/2004 | Angeliu | |
| 2005/0022959 | A1 | 2/2005 | Soderstrom et al. | |

* cited by examiner

METHOD FOR INDUCTION STIRRED, ULTRASONICALLY MODIFIED INVESTMENT CASTINGS

CROSS REFERENCE TO RELATED APPLICATIONS

This application relates to and claims the benefit of U.S. patent application Ser. No. 13/330,879, filed Dec. 20, 2011, entitled "Induction Stirred, Ultrasonically Modified Investment Castings and Apparatus for Producing," the disclosures of which are incorporated by reference in its entirety.

FIELD OF THE INVENTION

The present invention is generally directed to apparatus for producing investment castings with a preselected grain structure, and specifically to producing a preselected grain structure in an investment casting by controlling the solidification process.

BACKGROUND OF THE INVENTION

Investment casting processing is particularly useful for casting where close tolerances or intricacy of design are factors. One example has been in the casting of airfoils such as turbine blades and vanes made from specialty alloys and subject to high temperature service. Investment casting permits casting of thin sections, such as the airfoil portion of a turbine blade.

Solidification of castings, including investment castings typically occurs through the mold walls, as heat is withdrawn from the casting. This solidification normally occurs through the casting walls, which transfer heat from the molten metal in the casting to the ambient atmosphere. As heat is withdrawn, nucleation sites form on the mold walls and solidification fronts grow into the molten metal as dendrites.

Grains also are heterogeneously nucleated by solid fragments in front of the solid/liquid interface. The number of these solid fragments is proportional to the amount of undercooling. The morphology of the nucleated grains is determined by the direction and the amount of heat flux at any given time.

What is needed is a casting system that permits additional controls over the solidification of the metal or metal alloy during solidification to homogenize temperature distribution, reduce segregation and break/distribute volumetric imperfections in the casting, when required.

SUMMARY OF THE INVENTION

A casting unit for producing induction stirred, ultrasonically modified investment castings is set forth. The casting unit comprises an investment casting mold having a mold cavity. The casting unit also includes a furnace. A first zone of the furnace includes a means for generating a convection current in molten metal when the mold is provided with molten metal. The first zone receives the investment casting mold. A refractory divider defines the first zone, surrounding the working zone. However, energy may be transferred across the divider to/from the first zone. The first zone also is surrounded by insulation so that rapid transfer of heat across the furnace boundaries to the ambient surroundings does not occur. An ultrasonic source for delivering an ultrasonic pulse into the mold cavity when the mold cavity is provided with molten metal is positioned in contact with the bottom of the mold. A first heating element is located within the first zone between the refractory divider and the investment casting mold. Due to high preheat temperatures, these heating elements are non-metallic and are located within the first zone between the refractory divider and the investment casting mold.

A method for fabricating an equiaxed casting is also provided. The method comprises the steps of providing a furnace having a first zone or working zone that receives an investment casting mold. A means for generating a convection current in the mold when the mold is provided with molten metal is also provided. A refractory divider surrounds the first zone. Insulation surrounds the first zone of the furnace, slowing the transfer of heat from the furnace to the ambient atmosphere surrounding the furnace. A first heating element is positioned on the inside of the refractory divider, between the refractory divider and the investment casting mold. The first heating element enables the investment casting mold to be preheated, if desired, so that the temperature of the molten metal does not drop drastically upon introduction and may permit some control of the temperature of the molten metal in the first zone of the furnace during the solidification process. An ultrasonic source positioned in contact with the mold is provided for delivering an ultrasonic pulse into the mold cavity once molten metal is introduced into the mold cavity. The investment casting mold having a mold cavity is positioned within the first zone of the furnace. The molten metal is introduced into the mold cavity of the investment casting mold. The first heating element permits preheating the investment casting mold prior to introduction of molten metal into the mold cavity and may be used to regulate the temperature of the molten metal in the mold during the solidification process. Once introduced into the mold cavity, the molten metal will begin to solidify, typically in the form of dendrites growing from the mold surfaces into the molten metal. Ultrasonic pulses are introduced into the molten metal from the ultrasonic source, generating ultrasonic pulses or waves that are used to fracture the dendrites into fragments. These fragments are distributed through the molten metal by convection currents and may then serve as nuclei for the formation of additional grains. The convection currents are generated by waves from the ultrasonic source or are generated from the low output induction coils, or both. The low output induction coils operate in the range of from about 20 Hz to about 10 kHz for the purpose of generating convection currents.

The ultrasonic pulse also may be applied to the investment casting mold to disrupt the formation of dendrites that normally grow from the side of the investment casting mold as discussed above. The ultrasonic pulse also provides a mixing effect on the constituents of the liquid alloy and promotes the formation of equiaxed grains as growth from nucleation sites within the liquid metal is promoted. As the dendrites are broken from the side of the casting mold, they are mixed by both the pulse within the liquid and the convection current generated by the means for generating a convection current, and to the extent they do not completely melt, they also form additional nucleation sites for the formation of equiaxed grains. An investment casting having an equiaxed grain structure may be made by this process.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

A casting system is set forth that permits additional controls over the solidification of molten metal or metal alloy during solidification to stabilize the formation of an equiaxed microstructure during solidification. The system also provides for mixing of solute rich metal in the unsolidified molten portion of the casting as solidification progresses, allowing the composition gradient and the temperature gradient both to be controlled to allow for more uniform solidification. As used herein, metal or molten metal means metal or alloy, or molten metal or alloy, unless otherwise specifically specified.

Figure 1:
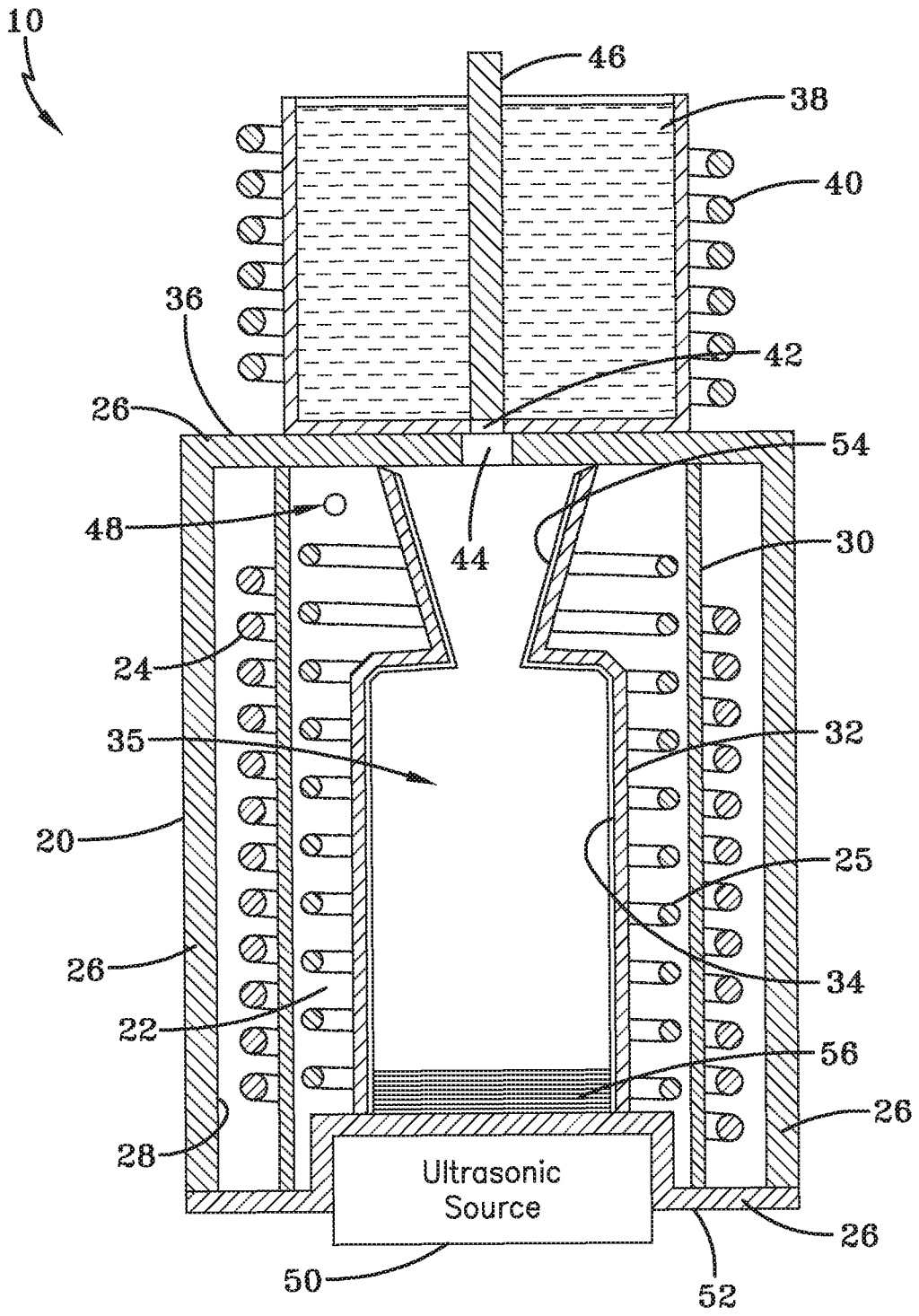
FIG. 1 depicts apparatus of the present invention in which molten metal has been introduced into a pouring cup or melting furnace, but not into an investment casting mold positioned in a working zone of furnace, the investment casting mold including both nucleating agents and thermally stable dispersion agents.

Referring now to FIG. 1, a casting unit 10 includes a furnace 20. The furnace includes a working zone, working zone including a first heating element 25. Furnace 20 is surrounded by insulation 26 to minimize the transfer of heat from inside furnace 20 through furnace walls 28 to the ambient surroundings. A refractory divider 30 separates first heating element from low output induction coils 24, the refractory divider 30 forming an arbitrary boundary for what is referred to interchangeably as the working zone or a first zone 22, the region within a boundary of refractory divider 30 being defined herein as the working zone or the first zone 22.

Working zone is sufficiently large to accommodate a precision mold such as made by the investment molding process. As used herein, such a mold is referred to as an investment casting mold, although any other mold may be inserted into working zone. Investment casting mold 32 is formed of a ceramic shell 34 forming a mold cavity 35, which optionally may be lined with a nucleating agent. Whether or not ceramic shell 34 is lined with a nucleating agent is dependent on the metal alloy that will be used to form the casting.

Attached to top 36 of first zone 22 is a second working zone or melting zone 38. Melting zone may be permanently attached to top 36 of furnace or removably attached to furnace 20. Preferably, melting zone 38 is removably attached for convenience to facilitate repairs to both melting zone as well as to first zone 22 and enable access to first zone 22. In an alternate embodiment, melting zone 38 may comprise a substantially permanently attached structure and a liner of melting zone 38 may be removable and replaceable. In one embodiment, the melting zone 38 is defined by a pouring cup, however, the specific configuration of melting zone 38 and its attachment to furnace top 36 is not an important aspect of the present invention. Melting zone 38 is surrounded by a second heating element 40.

Melting zone 38 and furnace top 36 also each include an aperture 42, 44 that provides fluid communication between melting zone 38 and investment casting mold 32 so that molten metal may flow from melting zone 38, through melting zone aperture 42 and furnace aperture 44 into mold cavity 35. Melting zone aperture 42 and furnace aperture 44 are depicted in a preferred embodiment of FIG. 1 as coaxial. However, while apertures 42 and 44 must provide fluid communication between melting zone 38 and mold 32, their configuration is not limited to the configurations set forth in FIGS. 1-4. A stopper 46 is used to regulate the flow of molten metal between melting zone 38 and mold cavity 35. Stopper 46 may be removably inserted into melting zone aperture 42 and/or furnace top aperture 44 for such flow regulation.

A system may be provided with means to maintain an atmosphere within working zone. The atmosphere may be a protective atmosphere within working zone of furnace 20, such as an atmosphere of nonreactive gas or an inert gas such as Ar, He and the like, or to provide a vacuum 48 within working zone. A vacuum system 48 is preferred to permit degassing of working zone as the molten metal is poured into investment casting mold 32, minimizing the formation of defects due to porosity. However, the inclusion of a system that provides a protective atmosphere or a vacuum is optional. In addition, if desired, all of furnace 20, including furnace top 36, second melting zone 38 and second heating element 40, may be placed within the selected atmosphere.

An ultrasonic source 50 is in contact with the bottom 52 of furnace 20 on an exterior side of furnace 20, while investment casting mold 32 rests on the opposite or interior side of furnace 20. Ultrasonic source 50 is a transducer that converts an electrical signal into a mechanical signal. In order for the ultrasonic source to properly convert an electrical signal into a mechanical signal or ultrasonic wave, the transducer, comprised of a piezoelectric material, must be maintained below its Curie temperature. The transducer, therefore, either must be cooled or separated from furnace 20 by a sufficient distance so as to remain cool. Also, in order to transmit the mechanical signal across interface boundaries with minimal loss, which boundaries occur at least at the transducer/furnace interface and the furnace/mold interface, a liquid couplant desirably is used, as the ultrasonic wave is transferred effectively through liquid and many solids, but not so effectively, if at all, across air or gas.

Solutions to these problems are not part of the present invention, although solutions are available and known to those skilled in the art. For example, ultrasonic source 50 may be spaced from furnace bottom 52 with a steel or nickel superalloy bar or other high melting metal bar so that ultrasonic source 50 remains below its Curie temperature. The ultrasonic source 50 may be coupled to the bar with a standard couplant, and the bar will effectively transmit the ultrasonic wave. If necessary, the metal bar may be cooled by any suitable means.

In another embodiment, a water jacket using a copper chill may be used between ultrasonic source 50 and furnace bottom 52 to maintain the ultrasonic source 50 below its Curie temperature, while maintaining a second couplant between the water jacket and the furnace bottom at a temperature sufficient to maintain the interface between the ultrasonic source and the furnace bottom to transmit the ultrasonic pulse, the first couplant coupling the ultrasonic source 50 to the water jacket. The temperature of the couplant is maintained sufficiently low to prevent vaporization or oxidation of the couplant so that it remains in its liquid state. Within working zone, a third couplant between the furnace bottom and the investment casting mold can be provided by use of a thin layer of metal or alloy that has a melting temperature below that of the metal or alloy being cast and a vaporization temperature above the melting point of the metal or alloy being cast. For example, copper, tin or lead may be an effective couplant between the furnace bottom and the mold bottom for cast nickel-based superalloys. As previously noted, the metal or alloy selected as a couplant is chosen so that the melting temperature of the cast metal or alloy falls between the melting point of the metallic couplant and the vaporization temperature of the metallic couplant. In addition, the metal or alloy selected as a couplant should not react with investment casting mold or the furnace bottom. Some reactivity may be acceptable as the investment casting mold is expendable and the furnace bottom may be replaceable.

In yet another embodiment, the furnace may be bottomless and the investment casting mold may be inserted into the mold using a movable table or platform. The investment casting mold includes a spiral grain selector and a starter block. The investment casting mold rests on a water cooled chill which is in contact with ultrasonic source 50. High temperature couplants are provided as previously discussed. In this embodiment, heat is withdrawn from the bottom of the mold by water cooled chill. In normal solidification parlance, the use of a water cooled chill, which withdraws heat from the metal through the bottom of the mold would produce directionally solidified (DS) grains. The use of a spiral grain selector would normally produce a single crystal (SX) grain. However, it is believed that the ultrasonic pulse will break up the advancing solidification front so that neither standard DS grains or SX grain will form. Without wishing to be bound by theory, since heat is being withdrawn preferentially from the bottom of the investment casting mold, it is believed that the cast product will be a multigrained structure having a grain structure extending in a direction away from the direction of heat removal.

Refractory divider 30 separating low output induction coils 24 from first heating element 25 and defines working zone of furnace 20. Refractory divider 30 may be made of any material that is resistant to thermal shock and is structurally stable over a wide temperature range. Refractory divider 30 may be comprised of any refractory material such as, for example alumina, zironia, silicon carbide, composites of these materials or other materials and combinations thereof and the like.

Melting zone 38 provides molten metal for investment casting mold. Melting zone 38 may receive a charge of metal in its solid state or it may receive molten metal from a separate furnace, pouring ladle or other pouring device. When a solid charge of metal is provided, second heating element 40 may be used to melt it. When molten metal is provided to melting zone 38, second heating element 40 may be used to maintain the temperature if further refinement of the metal is required or to maintain the temperature of the molten metal at a temperature within the pouring temperature range of the metal or alloy. In addition to having the properties of the refractory divider, which includes resistance to thermal shock and structural stability over a wide temperature range, melting zone 38 should be non-reactive with the molten metal with which it will contact. Ideally, melting zone 38 should be erosion resistant. Some examples of refractory materials suitable for melting zone applications include mullite, alumina, cordierite and aluminum silicate as is known in the art.

Stopper 46 may be any high temperature material that will not react with the molten metal or alloy. For example, stoppers may be a high temperature ceramic rod or tube movable from a first position in which the communication between melting zone 38 and mold cavity 35 is available to accept the flow of molten metal, to a second position in which communication between melting zone 38 and mold cavity 35 is closed to prevent the flow of molten metal from melting zone 38 into mold cavity 35. Although shown as a rod, stoppers may be discs, such as ceramic or CMC discs that engage or block openings 42, 44. Once inserted into apertures 42, 44, stopper also provides a seal so that a vacuum may be pulled by vacuum system 48 or so that, when included, the optional inert or reducing atmosphere may be maintained within working zone. When the metal or alloy being cast is a low temperature material, such as copper and its alloys, stoppers may be comprised of a higher melting point alloy such as steel.

Casting unit 10 includes low output induction coils 24 and second heating element 40. Second heating element 40 desirably is a high output induction coil. The purpose of the second heating element 40, as previously noted, is to melt a metal charge provided in a solid state and/or to maintain the molten metal at a temperature above its melting temperature and at or above its pouring temperature. This also permits additional refinement of the molten metal in melting zone 38, if desired. The second heating element 40 may also be used preheat melting zone 38 so that the temperature drop of molten metal, as it is poured from a secondary melt source into melting zone 38 is minimized. If molten metal is not transferred from melting zone 38 into investment casting mold 32 immediately, second heating element 40 may be utilized to maintain the temperature of the molten metal above its melting point and at or near its pouring temperature until pouring is to be accomplished. It should be apparent to one skilled in the art that melting zone 38 and second heating element 40 are optional items in the present invention. For air melt superalloy castings, equiaxed grains may be achieved without the use of melting zone 38 and second heating element 40, since molten metal may be poured into investment casting mold 32 and equiaxed grains may be achieved within first zone 22 as set forth. Alternatively, investment casting molds may be poured and filled outside of casting unit 10 and then transferred while still molten into first zone 22.

Low output induction coils 24 are positioned adjacent to working zone. Their primary purpose is to contribute to convection of molten metal within mold 32. If desired, low output induction coils 24 may be divided into zones along the vertical height of furnace, and each zone can be individually controlled to adjust convection currents along the working zone of furnace 20. First heating element 25 may be a separate heating element from second heating element 40, or first and second heating elements 25, 40 may be different portions of the same heating element, although each portion is controlled by separate controls. First heating element 25 provides some temperature control of the molten metal within investment casting mold 32.

Referring again to FIG. 1, mold cavity optionally is provided with thermally stable dispersion agents, which may include surface treated oxides for oxide dispersion strengthening (ODS). These dispersion agents may be added to disperse second phase particles and uniformly disperse nucleating grains. Fine particle inoculants may also be provided in addition to or instead of the dispersion agents.

Optional nucleating agents 54 may be formed on shell 34 as it is formed or thereafter applied. Whether nucleating agents 54 are utilized depends upon the alloy being cast. For example, ferrosilicone may be added as a nucleating agent for cast irons to promote finer grain structures. Other nucleating agents 54 may be included for different alloys. When ductile iron is cast, silicon is used to promote formation of a second phase, while it is used to promote graphitization in cast irons. Boron and zirconium may be added to promote nucleation of equiaxed grains in nickel-based superalloys.

Figure 2:
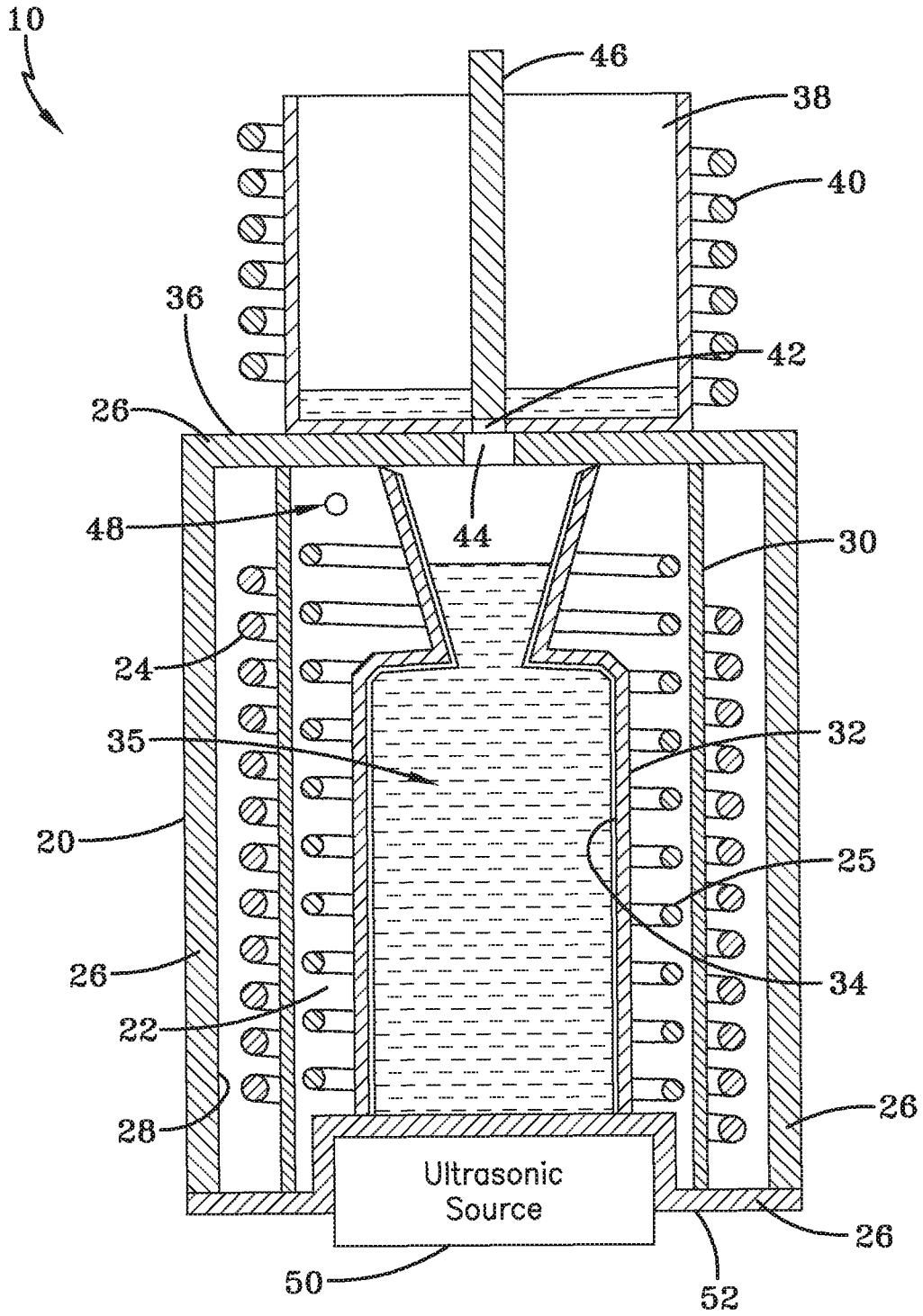
FIG. 2 depicts the apparatus of FIG. 1 in which molten metal has been transferred from the pouring cup into the investment casting mold.

Referring now to FIG. 2, molten metal has flowed from melting zone 38 to charge investment casting mold 32 with molten metal. Stopper 46 which was inserted in FIG. 1 is also inserted in FIG. 2 to seal working zone so that optional vacuum system can effectively evacuate any air in working zone, as well as any gases that devolve from the solidifying metal. Of course, access to the working zone of furnace 20 must be provided to enable insertion and removal of investment casting mold 32 into working zone of furnace 20. By charging superalloy metal into melting zone 38, the melting can be performed on a continuous basis and additional investment casting molds 32 can be placed under melting zone aperture. When casting is complete, a residual mold can be placed under melting zone aperture to capture the remaining molten metal.

In FIG. 2, the metal in mold 32 is in the molten state, and the thin sheets 56 of nickel, depicted as such in FIG. 1, have been melted by the molten metal. The sheets of nickel must be chemically compatible with the alloy being cast. Sheets 56 of different metal composition will be provided as the cast alloy composition is varied, the provided metal composition being compatible with the alloy being cast. Thus, in the embodiment depicted in FIGS. 1 and 2, the cast alloy is a nickel-based alloy, and the sheets in FIG. 1 are nickel sheets. It is understood by those skilled in the art that when a different alloy is cast, metallic sheets compatible with that alloy are provided. The thermally stable dispersion agents that were positioned at the bottom of mold 32 and the nucleating agent lining shell 34, as shown in FIG. 1, are now distributed throughout the molten metal after the sheets are melted. Solidification of the molten metal can be controlled by application of heat with first heating element 25. Depending upon the capacity of this heating element and the solidification temperature of the alloy being melted, application of heat with first heating element 25 can retard or even reverse solidification, if desired, and contribute to convection in convection currents in the molten metal, the convection currents circulating both dispersion agents and nucleating agents. This can be particularly effective when first heating element 25 is zoned so that heat can be applied to selected portions of working zone in a controlled fashion. Ultimately, the molten metal must be solidified, which is accomplished by transferring heat from the molten metal through the shell to working zone.

As the metal invariably cools on solidification, nucleation occurs on shell 34 and dendrites grow into the molten metal in the interior of mold 32. The convection currents in the metal may be insufficient to break up these advancing dendrites, which can adversely affect grain structure. To prevent the advancement of such dendrites, which will preferentially nucleate on the shell, the present invention applies an ultrasonic pulse from ultrasonic source 50 to the molten metal. As previously discussed, ultrasonic source 50 is positioned outside of furnace 20 and positioned so that it remains cool while solidification occurs, either by use of a chill or by distance. The ultrasonic pulse may be of any frequency and of any waveform, unlike carefully controlled ultrasonic beams used for testing and defect evaluation. The direction of application of the ultrasonic pulse to investment casting mold 32 should not be a factor. As shown in FIGS. 1 and 2, the ultrasonic source is positioned so that a longitudinal pulse would be delivered in a direction substantially transverse dendrites growing from the sidewalls of shell 34. But, it will be recognized by those skilled in the art that the ultrasonic source can be modified to deliver a transverse pulse into mold 32 at various angles, particularly between 45° and 60° directed to dendrites growing from the sidewalls of shell 34. Of course, more than one ultrasonic source may be used to deliver pulses from more than one direction, or an array of transducers can deliver pulses in a programmed pattern. However, the ultrasonic pulse must be of sufficient amplitude to break the dendrites, that is, to separate the dendrites from the shell, before the dendrites advance into the molten metal or to break the dendrites. An additional advantage of the ultrasonic pulse is that also it will provide a mixing of the molten metal; thus as the dendrites are separated from shell 34, they will be mixed with the molten metal, and serve as nuclei for growing grains in the solidifying metal. Although the preferred embodiment of the invention utilizes separate low output induction coils 24 to generate a conduction current, it will be understood by those skilled in the art that ultrasonic source 50 may provide an ultrasonic pulse of the same frequency as the low output induction coils, so that ultrasonic source 50 may function as both the sole source of the convection currents as well as an energy source of sufficient amplitude to fracture dendrites as discussed above, and that the means for generating a convection current includes either ultrasonic source 50, low output induction coils 24 or both. First heating element 25 also may contribute to the convection currents, although to a much lesser extent.

The ultrasonic pulse may be applied at any frequency as long at the amplitude is sufficient to separate dendrites from the mold wall and/or break dendrites. A frequency range from 15 kHz to 25 MHz may be utilized, although pulses in the range of about 19 kHz to 400 kHz are preferred, with a particular preference at about 60 kHz being most preferred. The important factor in generating ultrasonic pulses is the sufficiency of the amplitude generated. The amplitude of oscillation of the pulse determines the intensity of acceleration, which is the most important factor in controlling cavitation. Higher amplitudes create more effective cavitation. Unilateral direction of movement also assists with effective cavitation. The amplitudes preferred are between about 20 micrometers to about 110 micrometers, with 65 micrometers being the most preferred. Power output/surface area yields intensity, which is a function of amplitude, pressure, mold volume, temperature, molten metal viscosity and other factors. Total power output is a product of intensity and surface area. Total energy is a product of power output and time of exposure. Thus it can be seen that the energy value will vary depending on all of the parameters. However, preferred power densities fall within the range of 30-400 watts/ml of mold volume.

Ultrasonic source 50 may be run continuously or may be cycled on and off for short intervals of time, essentially creating a second frequency. It is preferred that ultrasonic source 50 be run continuously. Of course, the ultrasonic pulse will generate heat in the metal in investment casting mold 32, but the heat generated by the ultrasonic pulse is small as compared to the temperature of the molten metal or the heat that can be added by first heating element 25. The ultrasonic pulse may be arranged to operate, through a controller in conjunction with one or more thermocouples that determine the temperature of the molten metal in investment casting mold 32. As the solidification of metal of a known composition occurs over a temperature or range of temperatures and is exothermic, the ultrasonic pulse can be controlled to operate over this temperature or range of temperatures including a preselected tolerance band around the temperature or range of temperatures.

Since molten metal can be mixed, both the incident ultrasonic pulse from ultrasonic source 50, low output induction coils 24 and first heating element 25 contribute to convection currents, while preventing formation of and advancement of dendrites. This mixing of the molten metal and the application of heat provide other advantages. It uniformly distributes nuclei that will form grains as they develop. It provides mixing of the elements comprising the alloy as the alloy solidifies, so that the molten metal remaining as the grains grow has a more uniform composition. Mixing also provides a more uniform distribution of temperature as the alloy is mixed. As previously discussed, formation and growth of equiaxed grains is more favorable when the temperature of the remaining molten metal is neither supercooled nor cooled slowly, hence generating uniform-sized equiaxed grains. Here, because the mixing provides a more uniform distribution of temperature, there is not a temperature gradient that will favor growth of columnar grains. Finally, any precipitates that first form in the molten metal will be uniformly be distributed as a result of the mixing, and any precipitates that form in the solidified metal matrix will also be more uniformly distributed because the solidified metal will have a more uniform composition.

If it is necessary, because of the specific usage of the casting, to homogenize the casting to eliminate compositional differences as a result of segregation, a casting formed by the apparatus and methods of the present invention will require less homogenization time at elevated temperatures because the mixing of the alloy during the solidification process provides a better distribution of elements. Thus, there is a cost savings in energy usage as the homogenization time at elevated temperatures can be reduced.

Figure 3:
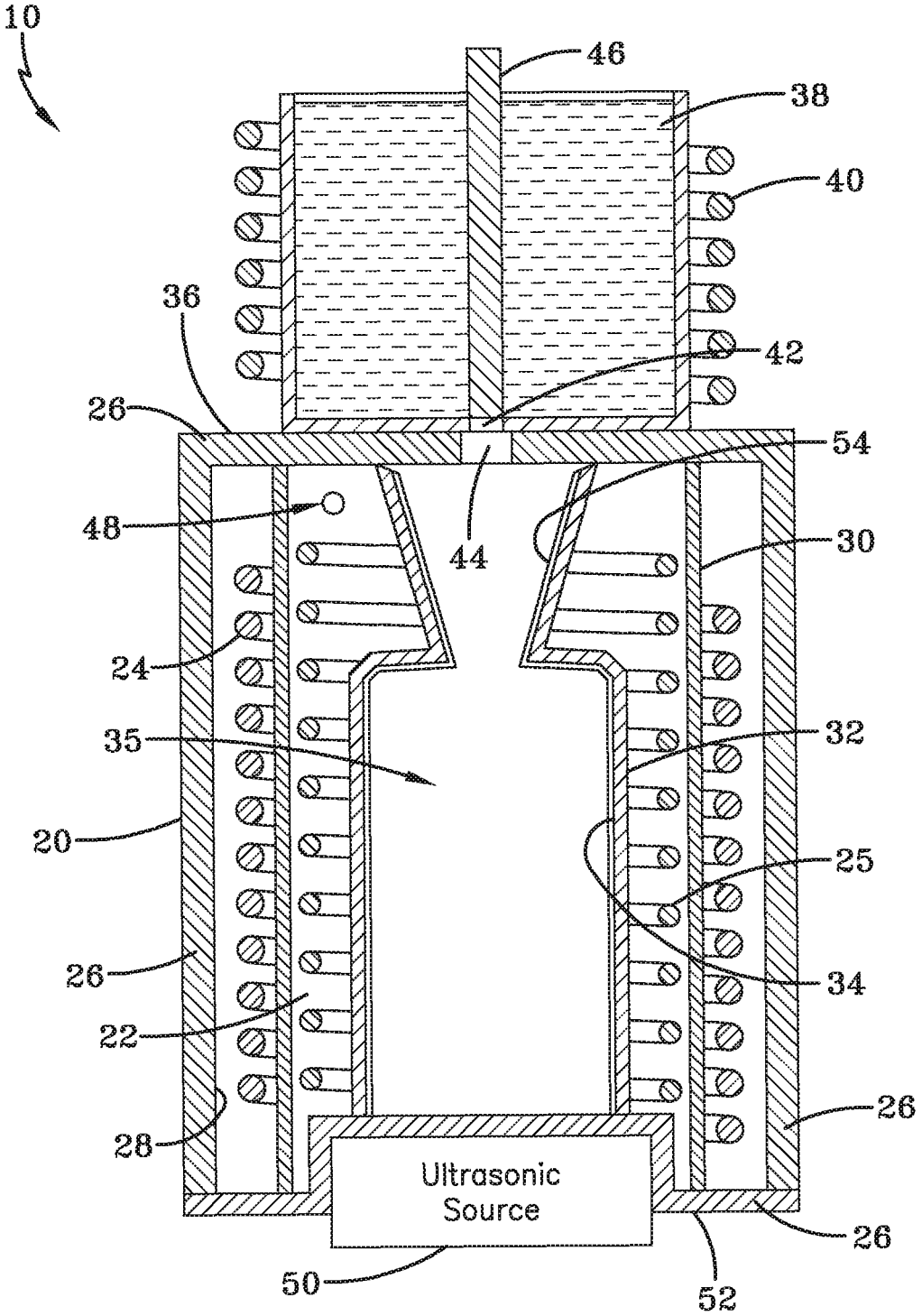
FIG. 3 depicts the apparatus of FIG. 1 in which molten metal has been introduced into a pouring cup, but not into an investment casting mold positioned in a working zone of furnace, the investment casting mold including only nucleating agents.
Figure 4:
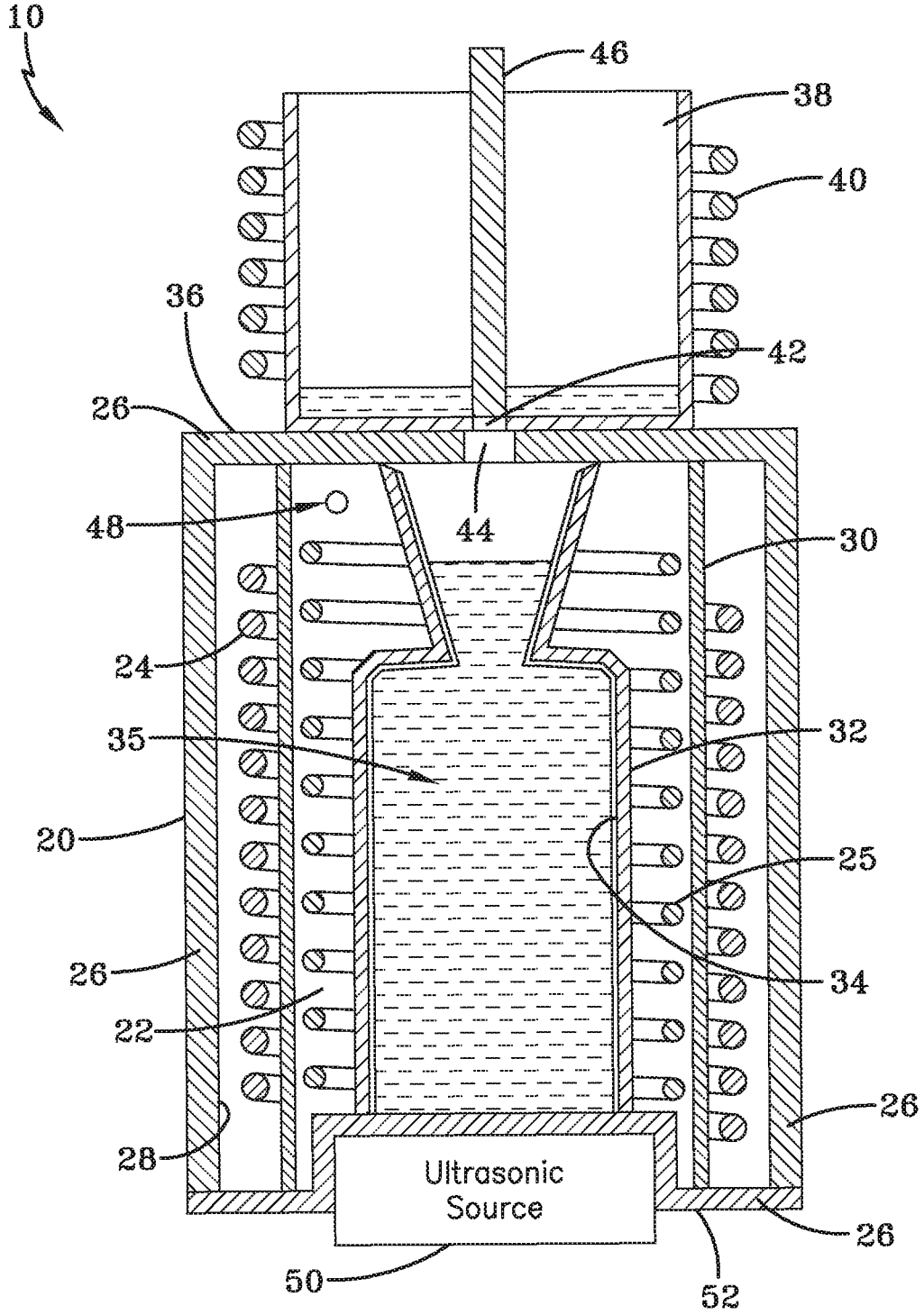
FIG. 4 depicts the apparatus of FIG. 3 in which molten metal has been transferred from the pouring cup into the investment casting mold.

FIGS. 3 and 4 are similar to FIGS. 1 and 2, but show a casting unit in which the shell includes nucleating agents, but no metal sheets 56 having thermally stable dispersion agents are included. As shown in FIGS. 3 and 4, these nucleating agents are shown lining the shell. The agents may be added to the shell as the shell is fabricated. But, the nucleating agents are not required to be fabricated with the shell. The nucleating agents may be added to investment casting mold 32 prior to pouring, as the combination of mixing and convection resulting from the ultrasonic pulse introduced by ultrasonic source 50, convection resulting from convection currents set up low output induction coils 24 and turbulence caused by the initial pouring of the molten metal into mold 32 should provide sufficient mixing to distribute the nucleating agents through the molten metal. The nucleating agents may also be introduced into second working zone or melting zone 38 of furnace 20 with solid metal prior to melting, simultaneous with the introduction of molten metal or into molten metal prior to transfer into second working zone 38 when a second source of molten metal is used to introduce the molten metal in furnace 20. The ultrasonic pulse, the convection currents set up by low output induction coils 24 and turbulence resulting from pouring should act in the same way to distribute the nucleating agents through the molten metal, even though the timing of the introduction of the nucleating agents into the molten metal is slightly different. Otherwise, the pouring and control of solidification to produce an equiaxed grain structure in the embodiment shown in FIGS. 3 and 4 is substantially the same as previously described for FIGS. 1 and 2.

The use of ultrasonic source 50 to introduce an ultrasonic pulse into molten metal assists in providing a casting having finer equiaxed grain sizes. The low output induction coils distribute nucleating grains and separated dendrites throughout the molten metal. The use of a heat source, depicted in the Figures as first heating element 25, to control the temperature distribution while avoiding superheating also contributes to the formation of the equiaxed microstructure. Of course other benefits are reduced compositional differences, that is, reduced microsegregation, in the resulting casting. Other advantages include a reduction in defects. Since the solidification rate can be controlled by use of first heating element 25, and the molten metal can be agitated by the ultrasonic pulse, gas that would otherwise be produced by the solidifying metal and trapped therein can be removed by the optional vacuum system when employed. The effect of other casting defects such as shrinkage can be reduced, as defects such as shrinkage can be more evenly distributed volumetric imperfections of smaller size. When present the location of such defects can be manipulated. Of course, the refined grain size produced by the apparatus and process set forth herein will produce a casting having higher strength which will result in a part having longer life. This, in turn, will lower life cycle costs in systems utilizing these parts. The parts previously described would be used in turbine applications, although different parts made by this process may certainly find use in other applications. In turbine applications, parts having a longer life can provide longer mean times between shut-downs for repair or replacement arising from such parts.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for fabricating an equiaxed casting, comprising the steps of:

providing an investment casting mold having a mold cavity;

providing a furnace having a working zone that receives the investment casting mold, means for generating a convection current;

a refractory divider surrounding the working zone;

insulation surrounding the working zone;

a first heating element positioned inside the working zone and positioned between the refractory divider and the mold cavity; and an ultrasonic source for delivering an ultrasonic pulse into the mold cavity when provided with molten metal and positioned in contact with the bottom of the mold;

placing the investment casting mold into the working zone;

providing molten metal to the investment casting mold;

as the molten metal begins to solidify in the mold cavity, applying an ultrasonic pulse to the investment casting mold, the pulse having sufficient amplitude to disrupt a formation of dendrites growing within the investment casting mold, the pulse further mixing the molten alloy;

continuing to apply the ultrasonic pulse to the investment casting mold to disrupt the formation of dendrites, mix the molten alloy and promote the formation of equiaxed grains as the molten metal solidifies.

2. The method of claim 1, wherein the means for generating a convection current includes a low output induction coil.

3. The method of claim 1, wherein the means for generating a convention current further includes the ultrasonic source.

4. The method of claim 1, wherein the ultrasonic pulse is generated in a frequency range from 15 kHz-25 MHz.

5. The method of claim 1, wherein the molten metal is initially provided into a melting zone in the furnace in an unmelted state, and the metal is melted by a second heating element surrounding the melting zone.

6. The method of claim 1, wherein the molten metal is provided to the melting zone from a separate source in a molten state.

7. A method for fabricating an equiaxed casting, comprising:

introducing molten metal into a casting unit, wherein the casting unit includes:

an investment casting mold having a mold cavity;

a furnace having:

a first zone that receives the investment casting mold;

induction coils;

a refractory divider surrounding and defining the first zone; and a first heating element positioned within the first zone between the investment casting mold and the refractory divider, the first heating element being separated from the low output induction coils by the refractory divider;

insulation surrounding the furnace; and an ultrasonic source;

disposing the investment casting mold into the first zone;

disposing the molten metal into the mold cavity of the investment casting mold;

generating a convection current in the molten metal in the mold using the induction coils; and applying an ultrasonic pulse from the ultrasonic source to the investment casting mold; and forming equiaxed grains as the molten metal solidifies.

8. The method of claim 7, wherein generating the convection current in the molten metal in the mold using the induction coils includes using low output induction coils.

9. The method of claim 7, wherein generating the convection current in the molten metal in the mold further includes the ultrasonic pulse from the ultrasonic source.

10. The method of claim 7, further including maintaining an atmosphere in the first zone.

11. The method of claim 10, wherein maintaining the atmosphere in the first zone includes maintaining the atmosphere selected the group consisting of a non-reactive atmosphere and a vacuum.

12. The method of claim 7 wherein the ultrasonic pulse is generated in a frequency range from 15 kHz-25 MHz.

13. The method of claim 7, wherein the molten metal is initially provided into a melting zone in the furnace in an unmelted state, and the metal is melted by a second heating element surrounding the melting zone.

14. The method of claim 7, wherein applying the ultrasonic pulse from the ultrasonic source to the investment casting mold includes applying the ultrasonic pulse as the molten metal begins to solidify in the mold cavity.

15. The method of claim 14, wherein applying the ultrasonic pulse from the ultrasonic source to the investment casting mold includes continuing to apply the ultrasonic pulse to the investment casting mold as the molten metal solidifies.

16. The method of claim 7, wherein applying the ultrasonic pulse from the ultrasonic source to the investment casting mold disrupts formation of dendrites growing within the investment casting mold.

17. A method for fabricating an equiaxed casting, comprising:

introducing molten metal into a casting unit, wherein the casting unit includes:

an investment casting mold having a mold cavity;

a furnace having:

a first zone that receives the investment casting mold;

low output induction coils;

a refractory divider surrounding and defining the first zone; and a first heating element positioned within the first zone between the investment casting mold and the refractory divider, the first heating element being separated from the low output induction coils by the refractory divider;

insulation surrounding the furnace; and an ultrasonic source;

disposing the investment casting mold into the first zone;

disposing the molten metal into the mold cavity of the investment casting mold;

generating a convection current in the molten metal in the mold using the low output induction coils;

applying an ultrasonic pulse from the ultrasonic source to the investment casting mold as the molten metal begins to solidify in the mold cavity, disrupting formation of dendrites growing within the investment casting mold;

continuing to apply the ultrasonic pulse to the investment casting mold as the molten metal solidifies, disrupting formation of the dendrites growing within the investment casting mold; and forming equiaxed grains as the molten metal solidifies.

18. The method of claim 17 wherein the ultrasonic pulse is generated in a frequency range from 15 kHz-25 MHz.

19. The method of claim 17, wherein the molten metal is initially provided into a melting zone in the furnace in an unmelted state, and the metal is melted by a second heating element surrounding the melting zone.

* * * * *